United States Patent [19]

Miller

[11] Patent Number: 4,610,793

[45] Date of Patent: Sep. 9, 1986

[54] OIL EXTRACTION METHOD

[76] Inventor: David P. J. Miller, 37 Binghill Park, Milltimber, Aberdeen AB1 0EE, Scotland

[21] Appl. No.: 658,783

[22] Filed: Oct. 9, 1984

[30] Foreign Application Priority Data

Oct. 8, 1983 [GB] United Kingdom ..... 8326964

[51] Int. Cl.[4] ..... E21B 43/24

[52] U.S. Cl. ..... 210/767; 166/60; 166/265; 166/303

[58] Field of Search ..... 210/767; 166/60, 265, 166/303

[56] References Cited

U.S. PATENT DOCUMENTS

| | | | |
|---|---|---|---|
| 1,499,589 | 7/1924 | Navin | 166/265 |
| 1,820,291 | 8/1931 | Strandell | 166/60 |
| 2,350,429 | 6/1944 | Troupe | 166/60 |
| 2,692,051 | 10/1954 | Webb | 166/265 |
| 2,738,409 | 3/1956 | Bowman | 166/60 |
| 3,342,267 | 9/1967 | Cotter et al. | 166/60 |
| 4,185,691 | 1/1980 | Tubin et al. | 166/60 |
| 4,241,788 | 12/1980 | Brennan | 166/265 |
| 4,285,401 | 8/1981 | Erickson | 166/60 |
| 4,296,810 | 10/1981 | Price | 166/265 |
| 4,378,846 | 4/1983 | Brock | 166/60 |

*Primary Examiner*—Tim Miles

*Attorney, Agent, or Firm*—Mason, Fenwick & Lawrence

[57] ABSTRACT

A downhole tool for use in recovering a first fluid from a mixture of fluids in a confined space, comprising a collector for the mixture, separator means for receiving the mixture from the collector and for separating the first fluid from the mixture, means for expanding the volume of the residual fluid of the mixture, and means for feeding the expanded fluid into the confined space thereby to provide sufficient pressure within the confined space to force uncollected mixture into the collector and then to the separator means.

5 Claims, 4 Drawing Figures

OIL EXTRACTION METHOD

This invention relates to a downhole tool.

Previously in extracting oil from underground reservoirs the oil has been brought to the surface by injecting high pressure fluid from the surface down the borehole. This pressurises the reservoir and forces the oil upwardly through a pipe to the surface. With this method however there is a limit to the amount of the oil in the reservoir that can be brought to the surface, because there is a significant pressure drop as the fluid for pressurising the reservoir is pumped down the borehole. In deep boreholes the pressure drop is such that it becomes difficult to extract a large proportion of the oil in the reservoir.

According to the present invention there is provided a downhole tool for use in recovering a first fluid from a mixture of fluids in a confined space, comprising a collector for the mixture, separator means for receiving the mixture from the collector and for separating the first fluid from the mixture, means for expanding the volume of the residual fluid of the mixture, and means for feeding the expanded fluid into the confined space thereby to provide sufficient pressure within the confined space to force uncollected mixture into the collector and thence to the separator means.

Preferably the means for expanding the volume of the residual fluid comprises an evaporator for converting liquid into gas. Said means for expanding may be in the form of a heater which serves also to raise the temperature of gas in the residual fluid. The residual fluid may be separated into liquid and gas if appropriate, before expansion.

Preferably also the expanded fluid is passed through pressurising means prior to the feeding means. The pressurising means may include an accumulator for storage of fluid at an elevated pressure so that the fluid fed into the confined space is at a controlled pressure.

The tool of the invention is especially useful in recovering crude oil from an oil well, and can allow greater quantitites of the crude oil to be recovered than with conventional apparatus in which well pressure is generated by supply of fluid into the well from the surface. The generation of pressure downhole, as in this invention, substantially prevents pressure losses in the fluid during supply to the well.

An embodiment of the present invention will now be described, by way of example, with reference to the accompanying drawings, in which.

Figure 1:
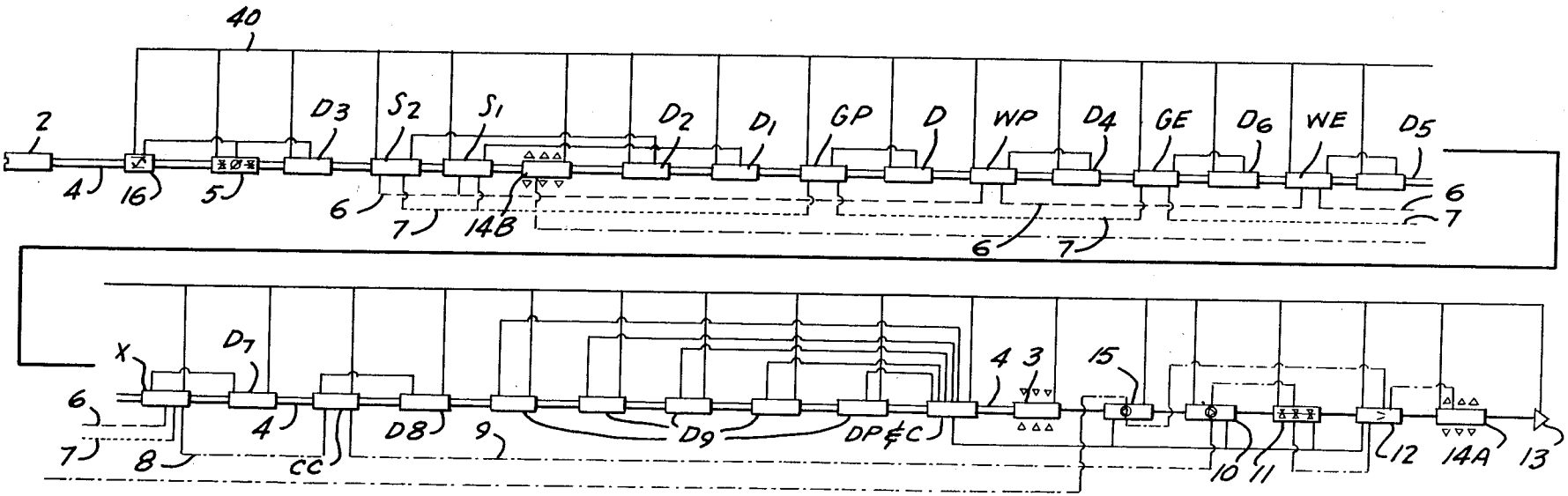
FIG. 1 is a schematic diagram of a downhole mineral oil extraction tool in accordance with the present invention.

Referring to the drawings the downhole mineral oil extraction tool of this embodiment is connected to a production string by a connector 2. The tool comprises a number of components which are shown schematically in FIG. 1. A mixture of oil, gas and water is extracted through an inlet 3 and passes through a pipe 4 until it reaches first and second separators S1 and S2 powered by dynamos D1 and D2 respectively, wherein the water and gas are removed from the crude oil. The oil passes on up the pipe 4 through a KGD turbine flow meter 5 powered by a dynamo D3 and through the connector 2 into the production string for collection at the surface.

The water and gas are also separated from one another in the separators S1 and S2 as will be described, and the water passes through a pipe 6 to a water processor WP, powered by a dynamo D4 in which salt in the water is broken down biologically into a saline solution to maintain the molecular structure of the water and remove unwanted products. The water passes from the processor WP along the pipe 6 to an evaporator WE powered by a dynamo D5.

The water enters the bottom of this unit and is evaporated into steam. The unit is constructed of a pressure vessel with a quartz heater which provides temperatures to 1800° F. The quartz heater is U.L. recognized and ranges in diameter from $\frac{3}{8}''$ to $\frac{3}{4}''$, in length up to 60", and in wattage up to 5400W.

The quartz heater is mounted and earthed to an internal wall of the pressure vessel which, in turn, is earthed to the tool itself. A thermostat is fitted into the pressure vessel, and operates as follows:

Ranges: 0–85; 0–120; 0°–300°

Copper and S.S. bulbs and capillaries

Differential: 4° C. in 120° Range, 8/10° C.±4/5° in 300° Range

16 Amps—380/400 V resist load.

The thermostat is fitted into the top of the pressure vessel. An outlet pipe comes out of the top of the pressure vessel, where it is then fitted with a non-return valve and a vein pump located beneath the pressure vessel and another non-return valve.

A pressure relief pipe comes out of the top of the pressure vessel, where an actuator relief valve is fitted. The pipe then continues downstream below the lower non-return valve, i.e. the non-return valve on the downside of the vein pump, where it connects to the downstream pipe.

From the evaporator WE the steam passes along the pipe 6 to a mixer X.

The gas separated in the separator S1 and S2 is fed through a pipe 7 to a gas processor GP and thence to a gas heater GE which operates on the same principle and is constructed in the same manner as the water evaporator WE. The heater GE raises the temperature of the gas and is powered by a dynamo D6. The heated gas then passes through the pipe 7 to the mixer X powered by a dynamo D7 where it is thoroughly mixed with the steam from the pipe 6.

The mixer comprises a pressure vessel and a Scaba high flow impeller, which is driven on a shaft with a double mechanical seal and a snuff box with flushing water, and also a two row spherical roller bearing with adapter sleeve, a rigid coupling, and with a variable speed motor.

The capacity ranges are:

Power: 0.12 kW–7.5 kW

Volume: 0.1–50 Cu M

Viscosity: 1–50,000 cP

Thermal and pressure transducers are provided inside the pressure vessel. An inlet has a non-return valve and enters the bottom of the pressure vessel. An outlet is provided at the top where a non-return valve is fitted. it then has a regulator where the liquid passes down through to a vein pump.

The steam and gas mixture is fed through a pipe 8 to a cooler CC which is powered by a dynamo D8 and serves to regulate the temperature of the mixture to safe working levels. The cooler comprises three main components: a heat exchanger, a refrigeration unit, and a thermally insulated pressure vessel.

The feed-line from the centrifugal mixer X has a vein pump to draw the product down and a non-return valve into the thermal pressure vessel. The waste heat is taken off by means of a vein pump, a non-return valve being fitted on this line, and the waste heat is then fed into the heat exchanger. After cooling, the heat exchanger sends the mixture on an outward line on which a non-return valve is fitted. Through that outward line the cooled product enters a condenser, from which it passes through a non-return valve and into the refrigerator.

A proportion of the cooled mixture is taken off from the thermal pressure vessel, passes through a regulator and the vein pump into the heat exhanger, thus making a closed circuit.

The remainder of the cooled mixture is fed through the regulator on to a vein pump, and thence through a pipe 9 to an internal pump 10.

The pump 10 moves the mixture to a three stage turbine 11 which increases its flow rate and produces an even flow of the mixture into a rotary piston Wankel compressor 12 in which it is compressed twelve times by each piston. The capacity of the compressor 12 is from 500 PSI upwards, and the temperature rating is 400° C. After compression of the mixture it is fed through to a relief valve which automatically opens and allows the mixture to pass through injection nozzles 14A and, via a pump 15, 14B, and thus into the formation below and above the oil reservoir.

This process maintains the pressure within the reservoir.

A sub-bottom profiler 13 is provided below the injection nozzles 14A and designed to be able to view above it to ensure that the hydraulics involved in the injection are right.

The profiler 13 is also able to view the level of oil in the reservoir and its location, thus providing a better picture of the behaviour of the reservoir and an indication of the total bulk of fluid left.

A computer 16 gathers and anaylses information from microprocessors installed in and sensing all information about each element of the tool, through data communication lines 40.

The computer 16 is powered by any of three methods:

sub surface power, i.e. a dynamo unit; surface power supply; or in the case of failure of both, a battery within the computer unit of the tool which are maintained at an adequate level of charge by automatic charging controlled by the computer.

The computer 16 has a built-in self-monitoring system which enables an operator or end-user to be made aware of any malfunctions as they may arise. This also allows an auxiliary on-board computer to take over while the down-computer will remain in a stand-by monitoring mode.

The computer 16 in this case is designed on an INSTEM computer system. The principal features of this system are as follows:

Principal Module: Single Board computer module
- Multifunction memory/Communications module
- Bulk memory module (256kB RAM)
- Power regulator module
- Power up-down module
- Alphanumeric display and keypad
- Graphics display and interface
- Digital input/output interface module Power Supplies: Powered from standard DC4 power supply (7.5 V, 1.5 A)
- Regulator module provides overcurrent/undervoltage protection
- Voltage and current indication outputs Environment: Temperature operating: 0° to 250° C. storage: −10° to 250° C.

Mechanical Features: 12-slot extended double Eurocard constructed in 9025 alloy
- polarised bottom connectors and top connectors
- modules located by anti-vibration sleeves secured by retaining screws The computer 16 is located in the top unit of the tool, and is constructed around the internal production pipe 4. Between the production pipe 4 and the computer 16 there is a heat shield. There is also a heat shield between the outerhousing and the computer. Between the heat shields and the computer there is an anti-magnetic shield.

The computer is mounted and secured by anti-vibration mountings and anti-vibration brackets. On the bottom and top mountings are fitted a set of shock absorbers which are themselves fitted with a heat shield.

The data transmission between each individual processor and the computer is by fibre-optic, thus reducing effects of temperature and magnetic and electric fields.

The data transmission and communication from the computer to the surface can be done in one of the following three methods:

1. An analogue or digital signal using an electrical signal along the transmission line.
2. Digital or analogue fibre channel.
3. Using a mechanical or electrical signal to the surface through the crude.

The same transmission methods apply to communication to the computer from the surface.

In the case where data has been transmitted to the surface, there will be one of two situations.

(a) Off-shore application

Signals to and from the computer are handled by a transceiver mounted on the sub-sea template which is in communication with any of four stations.

1. A platform.
2. Spur/tanker.
3. A floating production facility.
4. Ocean remote control communications system.

(b) On-shore application

There is a surface transceiver fitted to the wellhead, from which a land-line can be run to interface with any standard telecommunications system or satellite communication system.

Where a satellite communication system is used, either on-shore or off-shore, the transceiver communicates to the satellite which in its turn communicates with a data bureau or a main-frame. Both the data bureau and the main-frame are fitted with a 'watchdog' which triggers alarm systems allowing 24-hour coverage for any well.

Joints in the pipe 4 and between elements of the tool are Walther OP1011 joints adapted for downhole use.

Power control and distribution units are associated with each element of the tool, including a central such unit PD&C fed by adjacent dynamos D9 and connected to the pumps 10 and 15, turbine 11 and compressor 12.

The entire tool is contained within an outer casing of A.P.I. standard P10 steel.

In this embodiment the compressed mixture of water and gas is injected through nozzles 14A at the bottom of the tool and the nozzles 14B at the top, these injections being into a water reservoir and gas reservoir below and above the oil reservoir respectively. In other embodiments the injection may be only at the bottom of the tool through the nozzles 14A, or at the top through the nozzles 14B.

In cases of high volume output, accumulators may be included downstream of the cooler CC to allow controlled build-up of pressure.

In cases of low-pressure output, pumps may be provided downstream of the inlet 3 to assist in feeding the oil/water/gas mixture to the separators S1 and S2.

The dynamos may be replaced by a power source located at the surface and connected with the tool by electric cable.

Figure 2A:
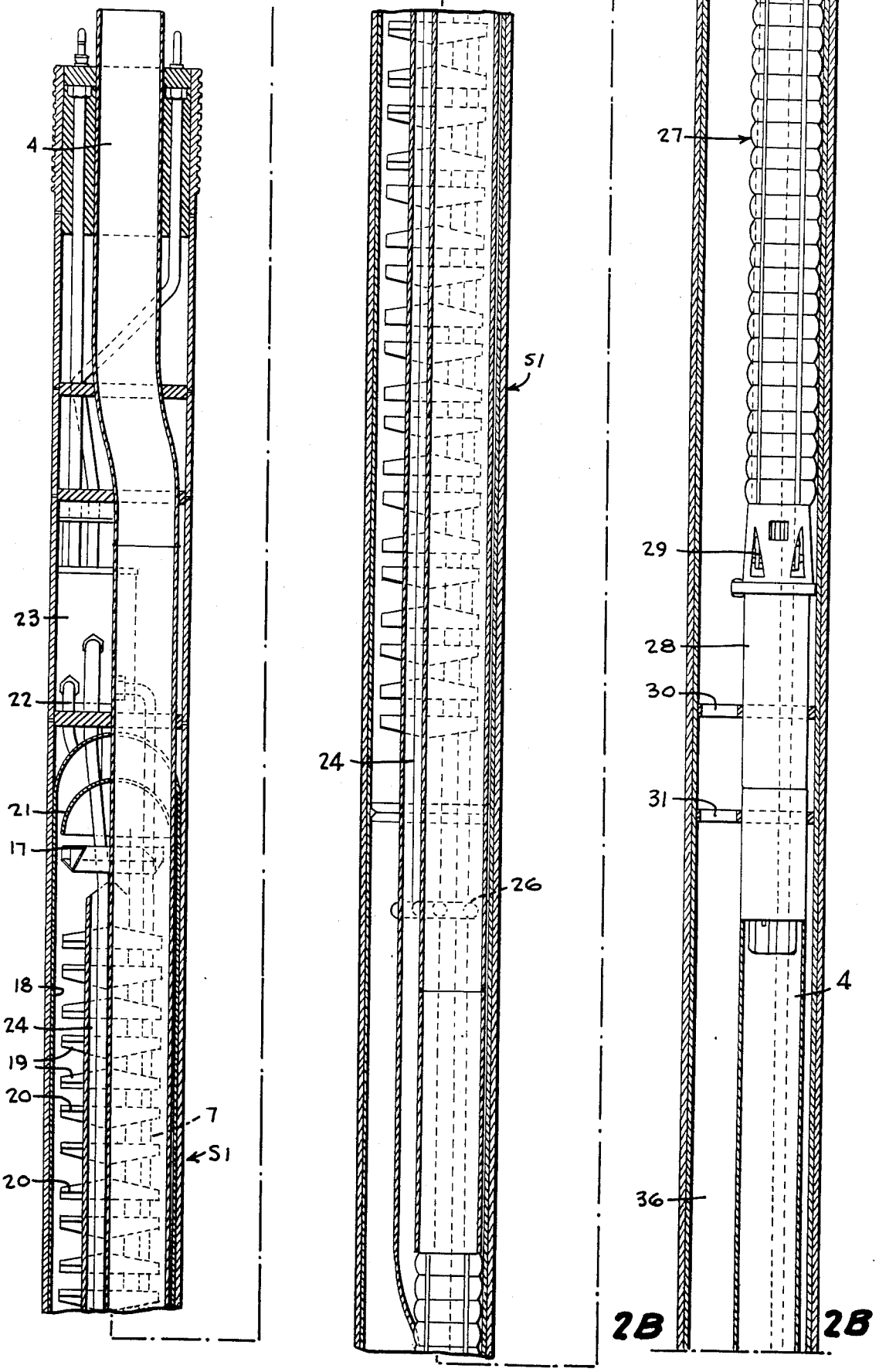
FIG. 2A is a partial sectional side view of one of the separators shown schematically in FIG. 1.
Figure 2B:
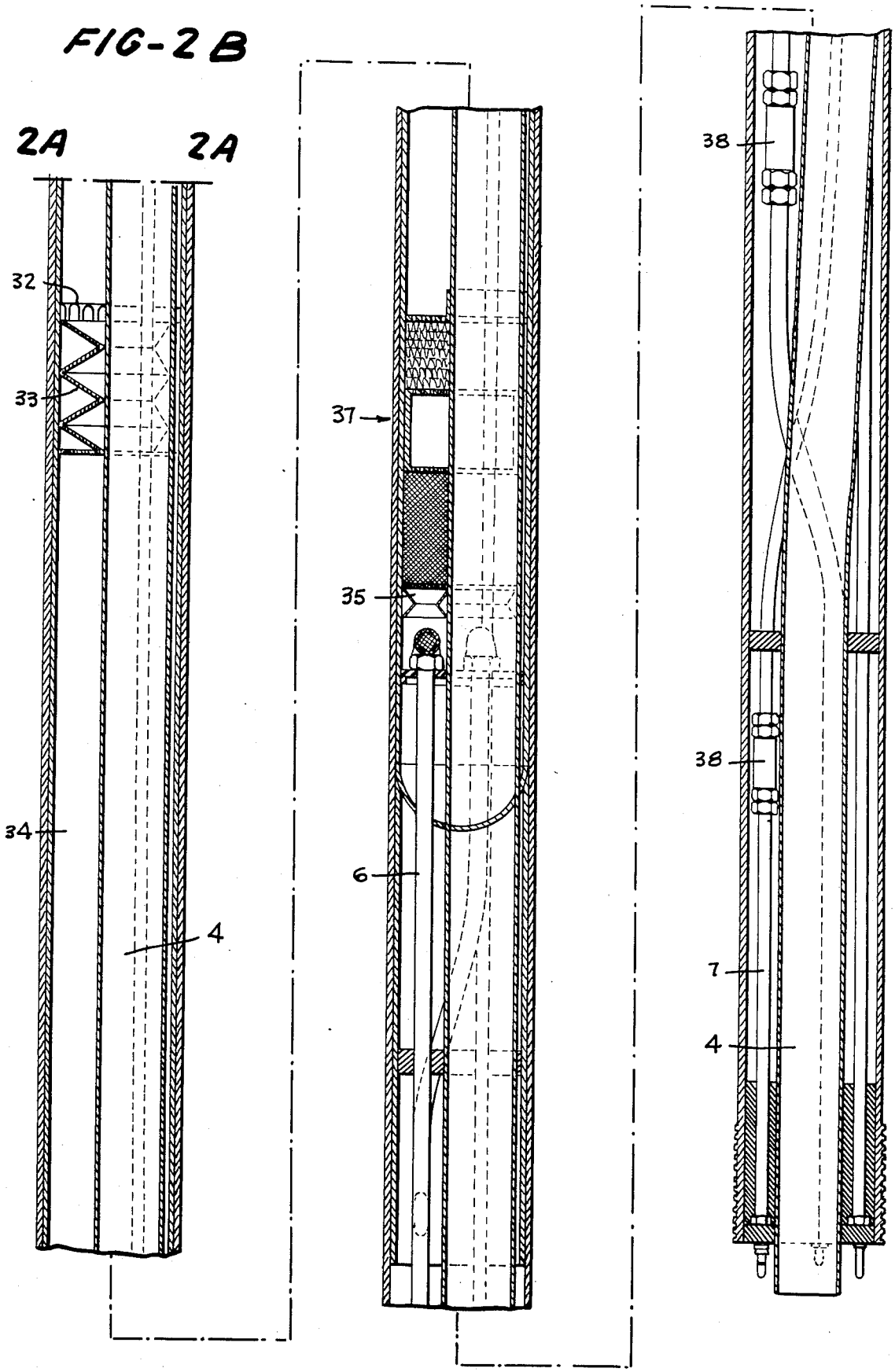
FIG. 2B is a partial sectional view comprising an extension from line 2B of FIG. 2.

The separator S1 is shown in more detail in FIG. 2. The crude oil/water/gas inlet mixture travels from the inlet 3 up through the tool and into the separator S1 until it hits a baffle plate 17 at the top section of a pressure vessel 18. Then the mixture falls over baffle trays 19, each of which is heated with a strip heater 20. The strip heater 20 has a stainless steel sheath and can operate from 20° F. to 750° F.

As the mixture falls over and through the baffle trays 19, the gas is lifted from the crude, and is caught in a gas cowl 21, pumped up by a vein type pump and sent through the pipe 7 for processing in the processor GP. A small amount of the gas is also taken off through a pipe 22 and compressed in a Free Piston System compressor 23. The Free Piston System consists of a single moving part, the piston, which is driven back and forth axially within a cylinder by an electromagnet and a spring; reciprocation of the piston is synchronized with the frequency of the electric current and the stroke adjusts freely for itself according to the outside load; an air bearing works between a piston and the inside wall of a cylinder: Nitto or a similar type of Free Piston System can be used.

The compressor 23 is located outside the pressure vessel 18. A compressor delivery pipe 24 comes through the top of the pressure vessel 18, through the cowl, and down in the raw crude delivery pipe 4, and then re-enters the pressure vessel, where it forms around the raw crude delivery pipe 4 and injects the compressed gas through a downward set of nozzle jets 26.

A submersible pump 27 inside the pressure vessel 18 is for the purpose of passing crude from the First stage separation to the Second stage separation, and then on to export. The pump 27 is a multi-stage centrifugal pump manufactured in Hastelloy and is directly coupled with a submersible motor 28 fitted underneath the pump 27; therefore the motor is designed with the minimum diameter. Suction is effected through a strainer 29 between the pump 27 and the motor 28. The pump 27 is crude-lubricated and has a non-return valve built into the top.

The top section of the pump 27 is welded to the top section of the export production pipe 4.

The motor 28 is secured by two pressure rings 30,31 which are fitted around the motor, and the pressure vessel walls. The crude oil and the water separate as they fall through the baffle trays 19, and they hit a first-stage weir 32.

The water hits the water weir 32 and then pours into a drain weir 33. Only water can pour through the drain weir 33 because of the acute angles that allow water to build up before draining, thus always keeping the oil afloat. The water then enters a water reservoir 34 where it passes through biological filtration at 37 and leaves by another weir 35 which is directly located under the main drainage system. Thereafter the water is sent through the pipe 6 for processing in the processor WP.

Inside the pressure vessel 18 there is a thermal transducer which measures the temperature within the pressure vessel. There are also two pressure transducers, one located at the top and one located at the bottom of the pressure vessel 18. Furthermore, there are two liquid level transducers, one in the oil sump 36 and the other in the water sump 34.

Outside the pressure vessel 18 in housings 38 there are two flowmeters, one to measure the gas-line and the other to measure the water-line. At the top of the pressure vessel 18 and above the compressor 23 and the vein pump, is situated the power distribution and control unit. Above that is situated a microprocessor which communicates data to and from the computer 16.

To keep the entire system cool a number of Supercool units are provided.

Heat shields are fitted to the P.D. & C system and the microprocessor, and anti-electric-magnetic shields are also fitted. The pressure vessel and associated equipment are mounted on anti-vibration pads and shock-absorbers.

The principle of the second-stage separator is identical to that of the first-stage separator, except that there is a tank flush injection valve to return waste products back to the crude.

Figure 3:
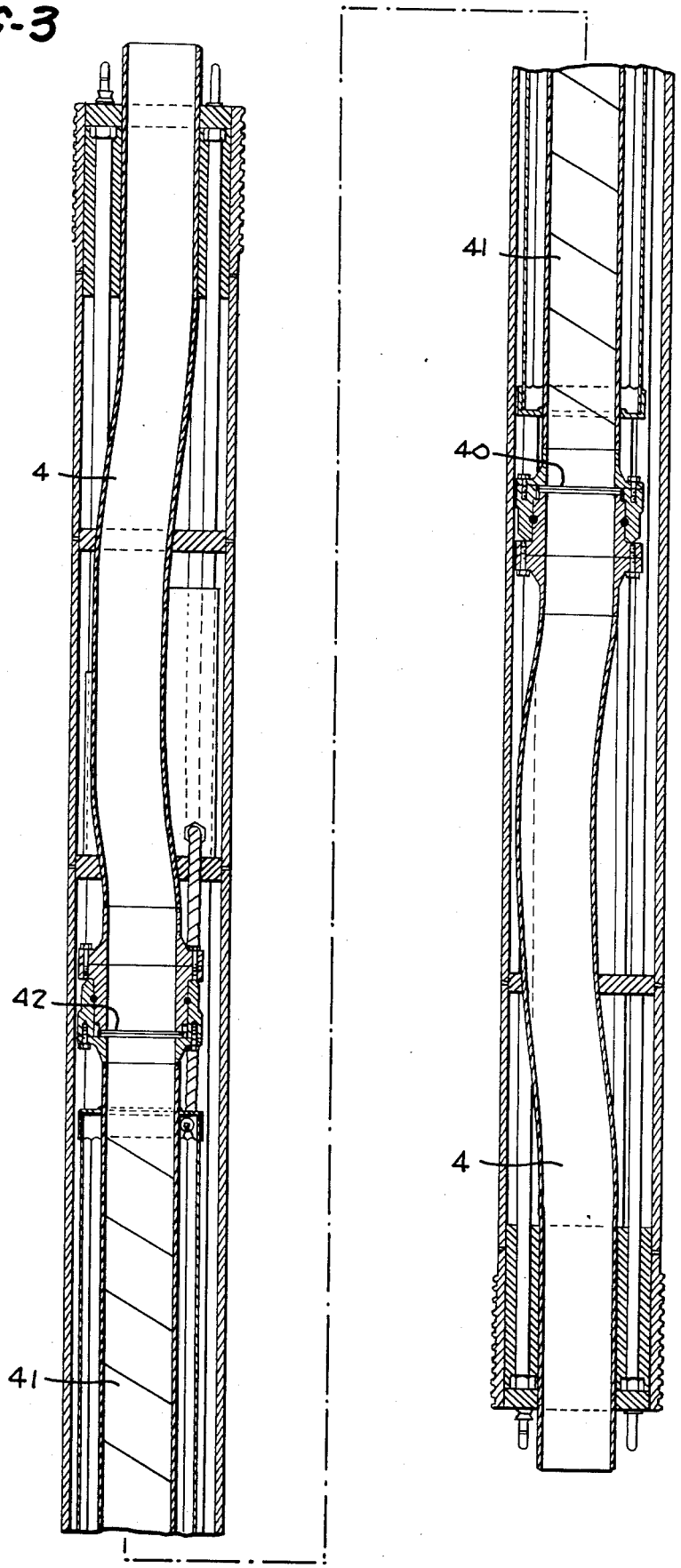
FIG. 3 is a sectional side view of one of the dynamos shown schematically in FIG. 1.

Referring now to FIG. 3, the purpose of having dynamos is to overcome the problem where top-side power supply cannot be introduced easily, or where the depth of the reservoir is so great that it would be difficult to run cables to the tool, and where there is sufficient volume and velocity of raw crude to generate its own power supply.

The raw crude travels up the production tube 4, passes a lower bearing 40 until it hits a helical vane section 41 causing it to rotate, and next passes through a top bearing 42 and out through the top section of the production tube 4.

Each dynamo is designed to meet the power requirements of each power section which it drives.

There are additional dynamos designed to give spare capacity. These dynamos do not operate until they are required, being fitted with a clutch and a brake which prevent their being engaged until required.

The dynamo generates DC, therefore an AC/DC converter is built into the P.D. & C. unit. This is then interfaced with a microprocessor and back into the computer 16.

The tool of this embodiment of the invention allows a high percentage of oil to be recovered from a well by providing pressurised expanded gases downhole, these gases replacing the oil already removed and maintaining crude oil flow to the surface.

I claim:

1. A method of extracting oil from a mixture of oil and other fluid in an underground reservoir, comprising:

(a) providing separation means and heating means at the reservoir;

(b) withdrawing a portion of said mixture from the reservoir into the separator means;

(c) separating in the separator means the oil from said portion of the mixture to leave a residual fluid;

(d) passing the separated oil to the surface;

(e) heating the residual fluid in the heating means to provide a gas of increased volume; and (f) introducing the gas into the reservoir whereby the increased volume of the gas is sufficient to maintain the fluid pressure in the reservoir at the level prior to withdrawal of said portion of the mixture from the reservoir into the separator means.

2. A method according to claim 1, wherein said residual fluid comprises water and gas which are separated from one another in said separator means.

3. A method according to claim 1, wherein the water is evaporated to steam in a first portion of the heating means and the gas is heated in a second portion of the heating means, and the steam and heated gas are then mixed together prior to introduction into the reservoir.

4. A method according to claim 3, wherein the mixed steam and heated gas are compressed prior to introduction into the reservoir.

5. A method according to claim 1, wherein the stages are controlled and monitored by a computer sited at the reservoir.

* * * * *